US005352846A

United States Patent [19]

Sarrazin et al.

[11] Patent Number: 5,352,846

[45] Date of Patent: Oct. 4, 1994

[54] PROCESS FOR THE PRODUCTION OF AN OLEFIN-FREE TERT, AMYL ALKYL ETHER-RICH FRACTION AND A N-PENTANE RICH PARAFFIN FRACTION

[75] Inventors: Patrick Sarrazin, Rueil Malmaison; Jean Cosyns, Maule; Alain Forestiere, Vernaison; Jean-Paul Boitiaux, Poissy, all of France

[73] Assignee: Institut Francais du Petrole, Rueil Malmaison, France

[21] Appl. No.: 142,107

[22] Filed: Oct. 28, 1993

Related U.S. Application Data

[63] Continuation of Ser. No. 932,192, Aug. 21, 1992, abandoned.

[30] Foreign Application Priority Data

Aug. 23, 1991 [FR] France ..... 91 10625

[51] Int. Cl.[5] ..... C07C 41/06

[52] U.S. Cl. ..... 568/697; 585/310; 585/668

[58] Field of Search ..... 568/697; 585/668, 310

[56] References Cited

U.S. PATENT DOCUMENTS

| | | | |
|---|---|---|---|
| 4,193,770 | 3/1980 | Chase et al. | 568/697 |
| 4,361,422 | 11/1982 | Derrien et al. | 568/697 |
| 4,724,274 | 2/1988 | Boitiaux et al. | 585/668 |
| 5,136,108 | 8/1992 | Gaffney et al. | 568/697 |

*Primary Examiner*—Howard T. Mars
*Attorney, Agent, or Firm*—Millen, White, Zelano & Branigan

[57] ABSTRACT

The simultaneous production of an olefin-free, tert.amyl alkyl, ether-rich fraction an n-pentane-rich paraffin fraction, wherein a charge based on isopentenes is hydrogenated (1) under appropriate conditions to bring about a distribution of the methyl butenes close to thermodynamic equilibrium and then the hydrogenation effluent is treated in an etherification zone (2).

12 Claims, 2 Drawing Sheets

PROCESS FOR THE PRODUCTION OF AN OLEFIN-FREE TERT, AMYL ALKYL ETHER-RICH FRACTION AND A N-PENTANE RICH PARAFFIN FRACTION

This application is a continuation of application Ser. No. 07/932,192, filed Aug. 21, 1992 now abandoned.

BACKGROUND OF THE INVENTION

The invention relates to a process for the simultaneous obtaining of a tert. amyl ether (particularly TAME)-rich fraction and a n-pentane-rich fraction from a $C_5$ fraction containing isopentenes, cyclopentene and cyclopentadiene.

Cracking processes such as steam cracking, viscoreduction, coking and catalytic cracking supply olefin-rich $C_5$ fractions. Certain of these can contain significant proportions of methyl butenes (isopentenes).

This is in particular the case with steam cracking $C_5$ fractions, which can contain up to 10% of the mixture 2-methyl-1-butene, 2-methyl-2-butene and 3-methyl-1-butene. This fraction can simultaneously contain up to 20% of diolefins in the form of isoprene, pentadiene and cyclopentadiene. A typical composition of this fraction is given in table 1.

TABLE 1

| | % by weight |
|---|---|
| $C_4^-$ | 1 |
| $nC_5$ | 26 |
| $isoC_5$ | 24 |
| $nC_5^=$ | 4.5 |
| Methyl butenes | 12.0 |
| Cyclopentene | 1.5 |
| Isoprene | 13.5 |
| Pentadiene | 9.0 |
| Cyclopentadiene | 7.5 |
| $C_6^+$ | 1.0 |

On the basis of a catalytic cracking $C_5$ fraction, it is possible to hydrogenate the diolefins into olefins (with the exception of methyl butenes) as is described in the assignee's U.S. Pat. No. 4,724,274. The reaction takes place by passing the charge to be treated (cracking $C_5$ fraction) with hydrogen and 2 to 50 ppm by weight (expressed as sulphur based on the charge) of at least one compound of sulphur into contact with a supported catalyst containing at least one noble metal of group VIII, at a temperature of 20° to 150° C. and a pressure of 5 to 100 bar.

Moreover, during said hydrogenation stage it is possible with respect to the isopentene to isomerize 3-methyl-1-butene and 2-methyl-1-butene into 2-methyl-2-butene in order to obtain a distribution of these products in proportions close to thermodynamic equilibrium. This composition at equilibrium is shown in table 3.

TABLE 3

| | % by weight |
|---|---|
| 3-methyl-1-butene | 0.5 |
| 2-methyl-1-butene | 12.5 |
| 2-methyl-2-butene | 87.0 |

The steam cracking $C_5$ fractions differ from the catalytic cracking $C_5$ fractions by the presence of cyclopentadiene and cyclopentene in a significant quantity (cf. table 1). It has surprisingly been found that the use of a steam cracking $C_5$ fraction in place of a catalytic cracking $C_5$ fraction makes it possible to obtain a distribution of isopentenes even closer to thermodynamic equilibrium contitions.

It is also known that fractions rich in methyl butene (isopentenes) are preferred charges for the etherification of iso-olefins having 5 carbon atoms and which are also called isoamylenes by an alcohol (e.g. methanol) for producing a tert. amyl alkyl ether (e.g. tert. amyl methyl ether or TAME). This ether can advantageously be used in mixed form in car fuels in order to improve their research octane number (R.O.N.) and motor octane number (M.O.N.). These etherification processes are described in numerous patents, e.g. U.S. Pat. No. 4,336,407.

In general terms, prior to the etherification stage, the olefin compounds are not separated from the paraffin compounds in particular due to the high separation costs. After etherification the product obtained is a mixture of paraffins, olefins and tert. amyl alkyl ether (e.g. TAME).

It should be noted that only the iso-olefins present in the charge to be etherified are converted into ether. Thus, straight and cyclic olefins and saturated molecules are refractory to the etherification reaction.

The mixture obtained can be used directly in the composition of a car fuel, bearing in mind its properties. However, this has the disadvantage of introducing olefin compounds into the final fuel. It is known that although olefins generally have relatively high research octane numbers (R.O.N.), their motor octane numbers (M.O.N.) are very low. The development and marketing of increasingly high performance and sophisticated engines, as well as the elimination of lead from fuel, made necessary by the introduction of catalytic converters, have led to increasingly severe octane number and in particular M.O.N. specifications for car fuels. The constraints associated with the protection of the environment make it necessary to reduce the olefin content of fuels. Thus, it becomes disadvantageous to introduce these residual olefins into the fuels. This evolution has led to the appearance of separating columns downstream of the etherification units, so as to separate the olefins and paraffins from the ether produced. At present the standard practice consists of using ether for the fuels and recycling the mixture of paraffins and olefins to the steam cracking unit so as to produce other valorizable compounds such as ethylene and propylene. However, it is known that the ethylene and propylene yields obtained during steam cracking are very highly dependent on the quality of the charge to be cracked.

It is generally accepted that the ethylene and propylene yields are much higher when the cracked charge is formed from saturated molecules such as isoparaffins or preferably normal paraffins.

SUMMARY OF THE INVENTION

A novel process has now been found which, by the association of the hydrogenation, etherification and separation stages, makes it possible to advantageously improve the valorization of the steam cracking $C_5$ fraction.

DETAILED DESCRIPTION OF THE DRAWINGS

Figure 1:
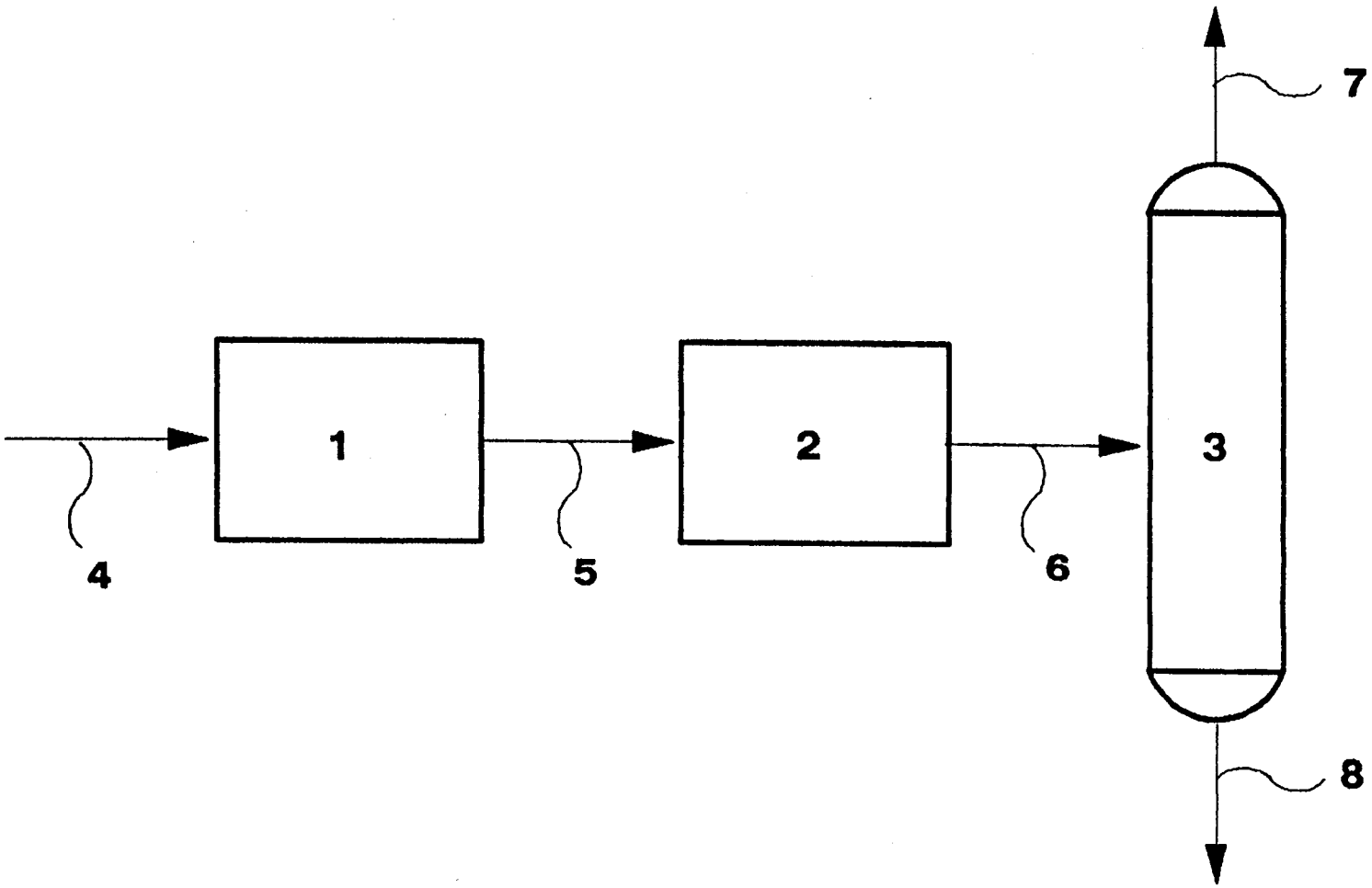
FIGS. 1 and 2 are schematic flowsheets of the two variants of the association or combination of hydrogenation, etherification, and separation stages according to the invention.

In the version illustrated by FIG. 1, the hydrogenation stage for the $C_5$ fraction arriving by pipe (4) makes it possible to supply the etherification unit (2) with a charge free from diolefins and straight chain olefins, as described in table 2. Moreover, the isomerization of methyl-1-butenes carried out during said stage 1 leads to the production of a large quantity of 2-methyl-2-butene.

Surprisingly, the performance characteristics of the etherification unit (2) are improved by the use of such a fraction both from the standpoint of the ether yield and from the standpoint of the catalyst life. The product (6) obtained in said etherification stage is fed into a separating column (3). At the head of the column is obtained a fraction containing only saturated molecules (7), which will form a better quality charge for steam cracking compared with a fraction still containing olefins. The bottom product of the column (8) constituted by a mixture of TAME and cyclopentane surprisingly has an improved quality compared with a mixture containing residual olefins, particularly with regards to the R.O.N. and M.O.N.

Figure 2:
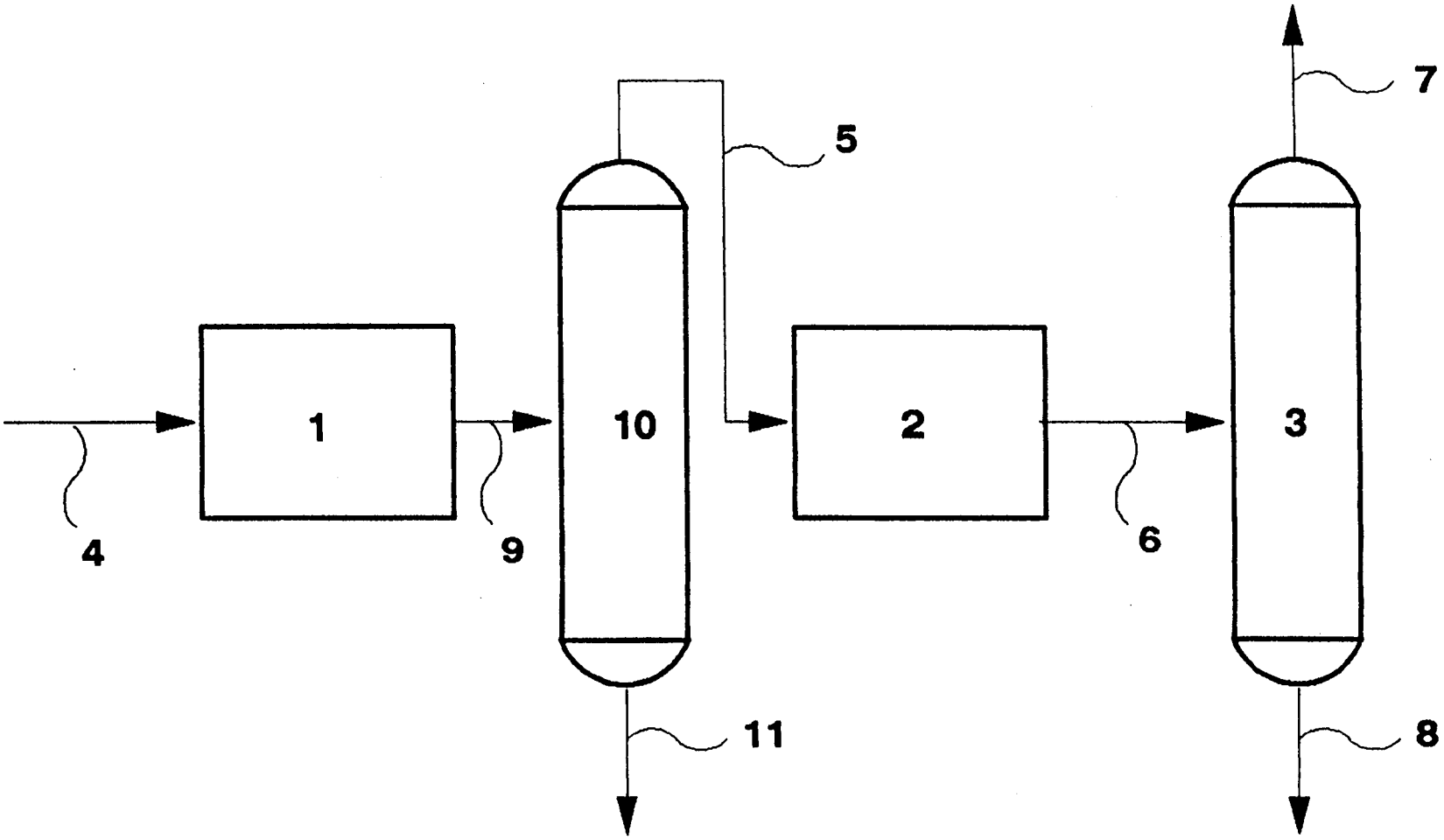

In the second version illustrated in FIG. 2, the hydrogenation stage is performed on a $C_5$ fraction at 200° C. which, after depentanization, by pipe (9) in column (10), will supply a $C_5$ fraction free from diolefins and straight chain olefins (5) to the etherification unit (2), which is followed by a separating column (3). The pipe (11) withdraws from the column (10) a $C_6+$ product (generally $C_6-200°$ C.).

Thus, the present invention relates to a process for the simultaneous production of a tert. amyl alkyl ether (e.g. TAME)-rich fraction which is substantially free from olefins and a n-pentane-rich paraffin fraction, characterized in that (a) the charge, which is a fraction based on olefin-rich $C_5$ hydrocarbons containing isopentenes (methyl butenes) and also cyclopentene and cyclopentadiene is firstly hydrogenated in a first stage under appropriate conditions to achieve a distribution of the methyl butenes close to thermodynamic equilibrium and in that (b) in a second stage the hydrogenation effluent is fed into an etherification zone for the iso-olefins by an alcohol, preferably methanol and in that (c), after distillation, collection takes place of a tert. amyl alkyl ether (e.g. TAME)-rich fraction and a n-pentane-rich fraction.

The following, non-limitative examples illustrate the invention:

EXAMPLE 1: (COMPARISON)

This example relates to the methoxylation reaction of a crude $C_5$ fraction obtained from a steam cracking unit. The composition of said fraction is given below:

| | % by weight |
|---|---|
| $C_4-$ | 1 |
| $nC_5$ | 24 |
| iso $C_5$ | 22 |
| $nC_5=$ | 5 |
| 3-methyl-1-butene | 6 |
| 2-methyl-1-butene | 4.8 |
| 2-methyl-2-butene | 2.4 |
| Cyclopentene | 2 |
| Isoprene | 14 |
| Pentadiene | 10 |
| Cyclopentadiene | 8 |

-continued

| | % by weight |
|---|---|
| $C_6+$ | 0.8 |

This fraction also has a sulphur content of 10 ppm. In order to carry out said methoxylation, there is a passage from bottom to top of the mixture of the $C_5$ fraction and methanol on a fixed catalyst bed of the ion exchange resin type in its acid form. They consist of crosslinked sulphonic polystyrene resins in the form of diameter 0.15 to 0.40 mm microspheres. The fixed catalyst bed is placed in a tubular reactor maintained under substantially isothermal conditions. Prior to use, the catalyst is impregnated with methanol.

The treatment conditions for said mixture are as follows:

| | |
|---|---|
| Pressure | 5 to 8 bar |
| Temperature | 65° C. |
| Charge volume flow per catalyst volume | 1 |
| Methanol flow in mole per mole of reactive isoamylene | 1 |

The term reactive isoamylene is understood to mean the sum of 2-methyl-1-butene and 2-methyl-2-butene.

The operation is carried out continuously for 100 hours. The conversion of reactive isoamylenes is 65%, but there is a progressive rise of the pressure drop in the reactor. When this pressure drop reaches 3 bar, the test is stopped and the catalyst discharged. The catalyst grains are agglomerated. Thus, these grains are embedded in a matrix formed by the polymerization of the diolefins of the charge. The following table gives the typical average compositions (in % by weight) of the charge and effluent of the reactor during the experiment.

| | Charge | Effluent |
|---|---|---|
| $C_4-$ | 1.0 | 1.0 |
| $nC_5=$ | 23.2 | 23.2 |
| Cyclopentane | — | — |
| iso $C_5$ | 21.3 | 21.3 |
| $nC_5$ | 4.8 | 4.8 |
| 3-methyl-1-butene | 5.8 | 5.8 |
| 2-methyl-1-butene | 4.7 | 0.2 |
| 2-methyl-2-butene | 2.3 | 2.2 |
| Cyclopentene | 1.9 | 1.9 |
| Isoprene | 13.6 | 13.6 |
| Pentadiene | 9.7 | 9.7 |
| Cyclopentadiene | 7.8 | 7.8 |
| $C_6+$ | 0.8 | 0.8 |
| Methanol | 3.1 | 3.1 |
| TAME | — | 6.6 |

EXAMPLE 2: (Comparison)

In this example, methoxylation takes place of the same steam cracking $C_5$ fraction after removing its diolefin compounds by selective hydrogenation. The selective hydrogenation is performed in the following way. The crude $C_5$ fraction is passed onto a fixed catalyst bed constituted by 0.3% by weight palladium deposited on a tetragonal gamma alumina in the form of spheres. The specific surface of the alumina is 60 $m^2/g$. The fixed catalyst bed is placed in a tubular reactor maintained under substantially isothermal conditions. Prior to use, the catalyst is reduced to atmospheric pressure under a hydrogen flow at 100° C. and for 2 hours.

The treatment conditions for the charge are as follows:

| | |
|---|---|
| Pressure | 25 bar |
| Temperature | 80° C. |
| Charge volume flow per catalyst volume and per hour | 5 |
| Hydrogen flow in mole per mole of hydrocarbon charge | 0.5 |

The hydrogenated product has the following composition (% by weight):

| | % by weight |
|---|---|
| $C_4^-$ | 1 |
| $nC_5$ | 25 |
| Cyclopentane | 1 |
| Isopentane | 22.5 |
| $nC_5^=$ | 14 |
| 3-methyl-1-butene | 3.3 |
| 2-methyl-1-butene | 7.1 |
| 2-methyl-2-butene | 16.0 |
| Cyclopentene | 9 |
| Isoprene | — |
| Pentadiene | — |
| Cyclopentadiene | — |
| $C_6^+$ | 1 |

to this product is added methanol and the reactive olefins are methoxylated under the conditions described in example 1. During this experiment, which lasted 500 hours without any sign of catalyst deactivation, it was found that the pressure drop in the reactor did not evolve and on discharging the reactor there was no trace of the polymers described in example 1. In addition, the conversion of the reactive isoamylenes is very close to that given in example 1. The TAME composition of the effluent is 19.8% by weight, whereas it was only 6.6% by weight in example 1.

The following table gives the typical composition (in % by weight) of the charge and effluent of the reactor during the experiment.

| | Charge | Effluent |
|---|---|---|
| $C_4^-$ | 0.9 | 0.9 |
| $nC_5$ | 22.6 | 22.6 |
| Cyclopentane | 0.9 | 0.9 |
| iso $C_5$ | 20.3 | 20.3 |
| $nC_5^=$ | 12.7 | 12.7 |
| 3-methyl-1-butene | 3.1 | 3.0 |
| 2-methyl-1-butene | 6.6 | 0.7 |
| 2-methyl-2-butene | 14.4 | 6.7 |
| Cyclopentene | 8.1 | 8.1 |
| Isoprene | — | — |
| Pentadiene | — | — |
| Cyclopentadiene | — | — |
| $C_6^+$ | 0.9 | 0.9 |
| Methanol | 9.6 | 3.4 |
| TAME | — | 19.8 |

The effluent mixture of the reactor is then washed with water to eliminate the residual methanol and is then separated into two fractions by distillation and which have the following composition (in % by weight):

| | Charge | Distillate | Residue |
|---|---|---|---|
| $C_4^-$ | 0.9 | 1.2 | — |
| $nC_5$ | 23.6 | 31.5 | — |
| Cyclopentane | 0.9 | 0.3 | 2.8 |
| Isopentane | 21.0 | 28.1 | — |
| $nC_5^=$ | 13.1 | 17.5 | — |
| 3-methyl-1-butene | 3.1 | 4.1 | — |
| 2-methyl-1-butene | 0.7 | 0.9 | — |
| 2-methyl-2-butene | 6.9 | 9.2 | — |
| Cyclopentene | 8.4 | 7.2 | 11.9 |
| Isoprene | — | — | — |
| Pentadiene | — | — | — |
| Cyclopentadiene | — | — | — |
| $C_6^+$ | 0.9 | — | 3.6 |
| Methanol | — | — | — |
| TAME | 20.5 | — | 81.7 |

This gives a TAME-rich fraction, which can be directly incorporated into a petrol pool and which has a R.O.N. of 105 and M.O.N. of 95.4. The distillate contains 38.9% olefins, so that it is not very interesting for use as a steam cracker charge.

EXAMPLE 3: (According to the invention)

In this example methoxylation once again takes place of the same steam cracking $C_5$ petrol fraction after freeing it by advanced hydrogenation of its olefins and straight chain and cyclic diolefins. The isoamylenes are not affected by this hydrogenation and for these products a mixture is obtained, whose composition is close to that expected in thermodynamic equilibrium conditions.

The treatment conditions for said hydrogenation which takes place in the same apparatus and with the same catalyst as in example 2, are as follows:

| | |
|---|---|
| Pressure | 25 bar |
| Temperature | 120° C. |
| Charge volume flow per catalyst volume and per hour | 4 |
| Hydrogen flow in mole per mole of hydrocarbon charge | 0.7 |

The hydrogenated product has the following composition (in % by weight):

| | % by weight |
|---|---|
| $C_4^-$ | 1.0 |
| $nC_5$ | 39.0 |
| Cyclopentane | 9.8 |
| Isopentane | 23.0 |
| $nC_5^=$ | <10 ppm |
| 3-methyl-1-butene | 0.2 |
| 2-methyl-1-butene | 4.0 |
| 2-methyl-2-butene | 22.0 |
| Cyclopentene | — |
| Isoprene | — |
| Pentadiene | — |
| Cyclopentadiene | — |
| $C_6^+$ | 1 |

To this product is added methanol and the reactive olefins are methoxylated under the conditions described in example 1. During this experiment which lasted 500 hours there was no sign of catalyst deactivation and the pressure drop in the reactor did not evolve as had taken place in example 2. On discharge, the catalyst was in the same state as described in example 2 and there was no trace of the polymers described in example 1. Moreover, the conversion of the reactive isoamylenes is very close to that given in examples 1 and 2. The TAME composition of the effluent is 22%, which is above that resulting from the conditions described in examples 1 (6.6% by weight) and 2 (19.8% by weight).

The following table gives the typical composition (in % by weight) of the charge and the effluent of the reactor during the experiment.

| | Charge | Effluent |
|---|---|---|
| $C_4^-$ | 0.9 | 0.9 |
| $nC_5$ | 34.9 | 34.9 |
| Cyclopentane | 8.8 | 8.8 |
| isopentane | 20.6 | 20.6 |
| $nC_5^=$ | — | — |
| 3-methyl-1-butene | 0.2 | 0.2 |
| 2-methyl-1-butene | 3.6 | 0.7 |
| 2-methyl-2-butene | 19.7 | 7.4 |
| Cyclopentene | — | — |
| Isoprene | — | — |
| Pentadiene | — | — |
| Cyclopentadiene | | — |
| $C_6^+$ | 0.9 | 0.9 |
| Methanol | 10.4 | 3.6 |
| TAME | — | 22.0 |

The effluent mixture of the reactor is then washed with water to eliminate the excess methanol and then separated by distillation into two fractions having the following compositions (in % by weight):

| | Charge | Distillate | Residue |
|---|---|---|---|
| $C_4^-$ 5 | 0.9 | 1.3 | — |
| $nC_5$ | 36.3 | 53.2 | — |
| Cyclopentane | 9.1 | 1.5 | 25.5 |
| Isopentane | 21.4 | 31.4 | — |
| $nC_5^=$ | — | — | — |
| 3-methyl-1-butene | 0.2 | 0.3 | — |
| 2-methyl-1-butene | 0.7 | 1.0 | — |
| 2-methyl-2-butene | 7.7 | 11.3 | — |
| Cyclopentene | — | — | — |
| Isoprene | — | — | — |
| Pentadiene | — | — | — |
| Cyclopentadiene | — | — | — |
| $C_6^+$ | 0.9 | — | 2.8 |
| Methanol | — | — | — |
| TAME | 22.8 | — | 71.7 |

This gives a fraction rich in TAME and cyclopentane and with excellent octane numbers (R.O.N.=105.3 and M.O.N.=96) and which can be directly valorized in a petrol pool. The distillate, which contains 87.4% saturated compounds, including 53.2% n-pentane, is an excellent charge for the steam cracker.

EXAMPLE 4: (According to the invention)

The starting product of this example is the total steam cracking petrol fraction incorporating the $C_5$ fraction, but which has a final boiling point of 200° C. This petrol is firstly treated in a hydrogenation stage, whose aim is to eliminate all the diolefin and styrene compounds, together with the pentenes and cyclopentenes. This hydrogenation is carried out in the same apparatus as in examples 2 and 3 and also using the same catalyst, but with the following operating conditions:

| | |
|---|---|
| Pressure | 28 bar |
| Temperature | 130° C. |
| Charge volume flow per catalyst volume and per hour | 2 |
| Hydrogen flow in mole per mole of hydro- | 1 |

-continued

| |
|---|
| carbon charge |

The product obtained is then fed into a distillation column from which are drawn off the following fractions:

A $C_6$—200° C. bottom fraction

A $C_5$ head fraction having the following composition (in % by weight:

| | % by weight |
|---|---|
| $C_4^-$ | 1.2 |
| $nC_5$ | 38.8 |
| Cyclopentane | 10.8 |
| Isopentane | 22.0 |
| $nC_5^=$ | — <10 ppm |
| 3-methyl-1-butene | 0.3 |
| 2-methyl-1-butene | 3.9 |
| 2-methyl-2-butene | 21.5 |
| Cyclopentene | — |
| Isoprene | — |
| Pentadiene | — |
| Cyclopentadiene | — |
| $C_6^+$ | 1.5 |

To this product is added methanol and the reactive olefins are methoxylated under the conditions described in example 1. During this experiment which lasted 5 hours there was no deactivation of the catalyst and the pressure drop in the reactor did not evolve as was the case in examples 2 and 3. On discharging the catalyst the latter was in the same state as described in examples 2 and 3 and there was no trace of the polymers as described in example 1. The conversion of reactive isoamylenes is very close to that given in examples 1, 2 and 3. The TAME composition of the effluent is 21.6%, which is well above that resulting from the conditions described in examples 1 (6.6% by weight) and 2 (19.8% by weight).

The following table gives the typical composition (in % by weight) of the charge and the effluent of the reactor during the experiment.

| | Charge | Effluent |
|---|---|---|
| $C_4^-$ | 1.1 | 1.1 |
| $nC_5$ | 34.8 | 34.8 |
| Cyclopentane | 9.7 | 9.7 |
| isopentane | 19.7 | 19.7 |
| $nC_5^=$ | — | — |
| 3-methyl-1-butene | 0.3 | 0.3 |
| 2-methyl-1-butene | 3.5 | 0.7 |
| 2-methyl-2-butene | 19.5 | 7.3 |
| Cyclopentene | — | — |
| Isoprene | — | — |
| Pentadiene | — | |
| Cyclopentadiene | — | — |
| $C_6^+$ | 1.3 | 1.3 |
| Methanol | 10.1 | 3.5 |
| TAME | — | 21.6 |

The effluent mixture of the reactor is then washed with water to eliminate the excess methanol and then separated by distillation into two fractions having the following compositions (in % by weight):

| | Charge | Distillate | Residue |
|---|---|---|---|
| $C_4^-$ | 1.1 | 1.6 | — |
| $nC_5$ | 36.1 | 53.7 | — |
| Cyclopentane | 10.1 | 1.5 | 27.7 |

-continued

| | Charge | Distillate | Residue |
|---|---|---|---|
| Isopentane | 20.4 | 30.4 | — |
| $nC_5$= | — | — | — |
| 3-methyl-1-butene | 0.3 | 0.4 | — |
| 2-methyl-1-butene | 0.7 | 1.1 | — |
| 2-methyl-2-butene | 7.6 | 11.3 | — |
| Cyclopentene | — | — | — |
| Isoprene | — | — | — |
| Pentadiene | — | — | — |
| Cyclopentadiene | — | — | — |
| $C_6$+ | 1.3 | — | 4.0 |
| Methanol | — | — | — |
| TAME | 22.4 | — | 68.3 |

This gives a fraction rich in TAME and cyclopentane, which has excellent octane numbers (R.O.N. = 105 and M.O.N. = 95.5) and which can be directly valorized in a petrol pool. The distillate, which contains 87% saturated compounds, including 53.7% n-pentane, is an excellent charge for the steam cracker.

We claim:

1. A process for the simultaneous production of an olefin-free, tert-amyl alkyl ether-rich fraction and an n-pentane-rich paraffin fraction, comprising (a) in a first stage, hydrogenating a charge containing isopentenes (methyl butenes) cyclopentene and cyclopentadiene under hydrogenation and isomerization conditions sufficient to eliminate diolefins, cycloolefins, and straight-chain olefins and to obtain a distribution of the methyl butenes close to thermodynamic equilibrium; (b) in a second stage, feeding at least a fraction of the resultant hydrogenation effluent into an etherification zone for etherifying iso-olefins therein with an alcohol; and (c) distilling the resultant etherified stream from the etherification zone to collect (A) an olefin-free tert-amyl alkyl ether-rich fraction containing cyclopentane and (B) an n-pentane-rich fraction free of straight-chain olefins and cycloolefins.

2. A process according to claim 1, wherein the charge is a steam cracking effluent.

3. A process according to claim 1, wherein the hydrogenation stage (a) is performed by the passage of said charge with hydrogen and 2 to 50 ppm of at least one sulfur compound (ppm by weight sulfur based on the charge) into contact with a supported catalyst containing at least one noble metal from Group VIII at a temperature of 20° to 150° C. and under a pressure of 5 to 100 bar.

4. A process according to claim 1, wherein the alcohol is methanol and the ether produced is tert-amyl methyl ether.

5. A process according to claim 1, wherein at the end of the hydrogenation stage (a) and before the etherification stage (b), subjecting the hydrogenation effluent to fractionation to form a $C_5$-rich fraction and a $C_{6+}$-fraction and passing the $C_5$-rich fraction into the etherification zone.

6. A process according to claim 3, wherein the charge is a steam cracking effluent.

7. A process according to claim 6, wherein the alcohol is methanol and the ether produced is tert-amyl methyl ether.

8. A process according to claim 7, wherein at the end of the hydrogenation stage (a) and before the etherification stage (b), subjecting the hydrogenation effluent to fractionation to form a $C_5$-rich fraction and a $C_{6+}$-fraction and passing the $C_5$-rich fraction into the etherification zone.

9. A process according to claim 2, wherein the n-pentane rich fraction (B) is passed as a feed into the steam cracker from which the steam cracking effluent used as the charge is produced.

10. A process according to claim 6, wherein the n-pentane rich fraction (B) is passed as a feed into the steam cracker from which the steam cracking effluent used as the charge is produced.

11. A process according to claim 7, wherein the n-pentane rich fraction (B) is passed as a feed into the steam cracker from which the steam cracking effluent used as the charge is produced.

12. A process according to claim 8, wherein the n-pentane rich fraction (B) is passed as a feed into the steam cracker from which the steam cracking effluent used as the charge is produced.

* * * * *